US007097496B2

(12) United States Patent
Zhang et al.

(10) Patent No.: US 7,097,496 B2
(45) Date of Patent: Aug. 29, 2006

(54) CONNECTOR FOR FLEXIBLE PRINTED CIRCUIT

(75) Inventors: Chi Zhang, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/123,341

(22) Filed: May 5, 2005

(65) Prior Publication Data

US 2006/0105621 A1 May 18, 2006

(30) Foreign Application Priority Data

Nov. 18, 2004 (CN) ..... 2004 2 0109012

(51) Int. Cl.
*H01R 9/07* (2006.01)

(52) U.S. Cl. ..... 439/495; 439/260

(58) Field of Classification Search ..... 439/495, 439/260, 496, 492, 499, 357, 358
See application file for complete search history.

(56) References Cited

U.S. PATENT DOCUMENTS 4,629,271 A * 12/1986 Awano ..... 439/260
5,213,534 A * 5/1993 Gardner et al. ..... 439/495
5,727,968 A * 3/1998 Ito ..... 439/495
6,004,156 A * 12/1999 Roque et al. ..... 439/495
6,315,603 B1 * 11/2001 Miura et al. ..... 439/495
6,319,052 B1 * 11/2001 Chang ..... 439/495
6,561,843 B1 * 5/2003 Ma et al. ..... 439/495

* cited by examiner

*Primary Examiner*—Hien Vu
(74) *Attorney, Agent, or Firm*—Wei Te Chung

(57) ABSTRACT

A connector (100) includes a housing (1) having a lower wall (12) and an upper wall (13) defining a cavity (11) therebetween opened to a front face (10) thereof; terminals (2), each of which is provided with a fixed arm (21) fixed on the lower wall and a resilient arm (22) received in the upper wall and partly extending into the cavity; and an actuator (3) comprising a tongue (32) movably received in the cavity. The tongue has an under surface (321) defining a plurality of slots (323) to guidingly receive the fixed arms of the terminals for guiding the movement of the actuator. The slots extend throughout the tongue in a thickness direction thereof to form cutouts (324) at an end of tongue, thereby making the end of the tongue a comb-like shape.

16 Claims, 9 Drawing Sheets

CONNECTOR FOR FLEXIBLE PRINTED CIRCUIT

BACKGROUND OF THE INVENTION

1. Field of the invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC". The instant application relates to a contemporaneously filed application having the same title, the same applicants and the same assignee with the instant application.

2. Description of Related Art

U.S. Pat. No. 6,004,156 discloses a flexible flat connector including an insulative housing which retains a plurality of contacts and defines a receiving cavity for movably receiving an actuator. Each of the contacts has a fixed arm fixed in the housing and an opposing resilient arm extending into the receiving cavity. The actuator has a tongue received in the receiving cavity and movable between a closed position and an open position. The tongue has a top face adapted to retain a portion of a flexible flat cable whereby when the tongue is moved to the closed position, the portion of the flexible flat cable is moved into the receiving cavity and electrically engages with the resilient arms of the contacts. A plurality of spaced slots are defined in a bottom face of the tongue corresponding to the fixed arms of the contacts whereby when the tongue is moved from the open position to the closed position, the fixed arms of the contacts are guidingly received in the slots for guiding the movement of the actuator.

For more convenient insertion of a FPC, when the tongue is at the open position, the actuator will be tilted a little by raising its rear end that is out of the receiving cavity while its front end in the receiving cavity abutting against the housing. However, as the connector is of a lower profile and the tongue of the actuator is very thin one and therefore the slots are very shallow, when the actuator is tilted, the slots at the front end of the tongue are apt to disengage with the fixed arms of the contacts to make a flat front edge the tongue directly abut on the fixed arms. The front edge is apt to slide on the fixed arms along a direction perpendicular to an insertion direction of the actuator, which may result in misalignment between the actuator and the fixed arms of the contacts.

It is thus desired to provide an FPC connector of a lower profile having an actuator performing a well alignment with contacts thereof even when the actuator is tilted.

SUMMARY OF THE INVENTION

An object of the present invention is to provide an FPC connector having an actuator which can perform a well alignment with contacts thereof all through insertion of the actuator.

In order to achieve above-mentioned object, an FPC connector in accordance with a preferred embodiment of the present invention includes a housing having a lower wall and an upper wall defining a cavity therebetween opened to a front face of the housing; terminals, each of which is provided with a fixed arm fixed on the lower wall and a resilient arm received in the upper wall and partly extending into the cavity; and an actuator comprising a tongue insertable into the cavity. The tongue has a retaining surface adapted to retain the FPC to contact with the resilient arms, a guiding surface defining a plurality of slots to guidingly receive the fixed arms of the terminals for guiding the insertion of the tongue, and a plurality of cutouts at an end of tongue. Each cutout communicates with one of the slots and runs through the retaining surface and the guiding surface of the tongue thereby to make the end of the tongue a comb-like shape.

Other objects, advantages and novel features of the present invention will become more apparent from the following detailed description of the present embodiment when taken in conjunction with the accompanying drawings.

DETAILED DESCRIPTION OF THE INVENTION

Figure 1:
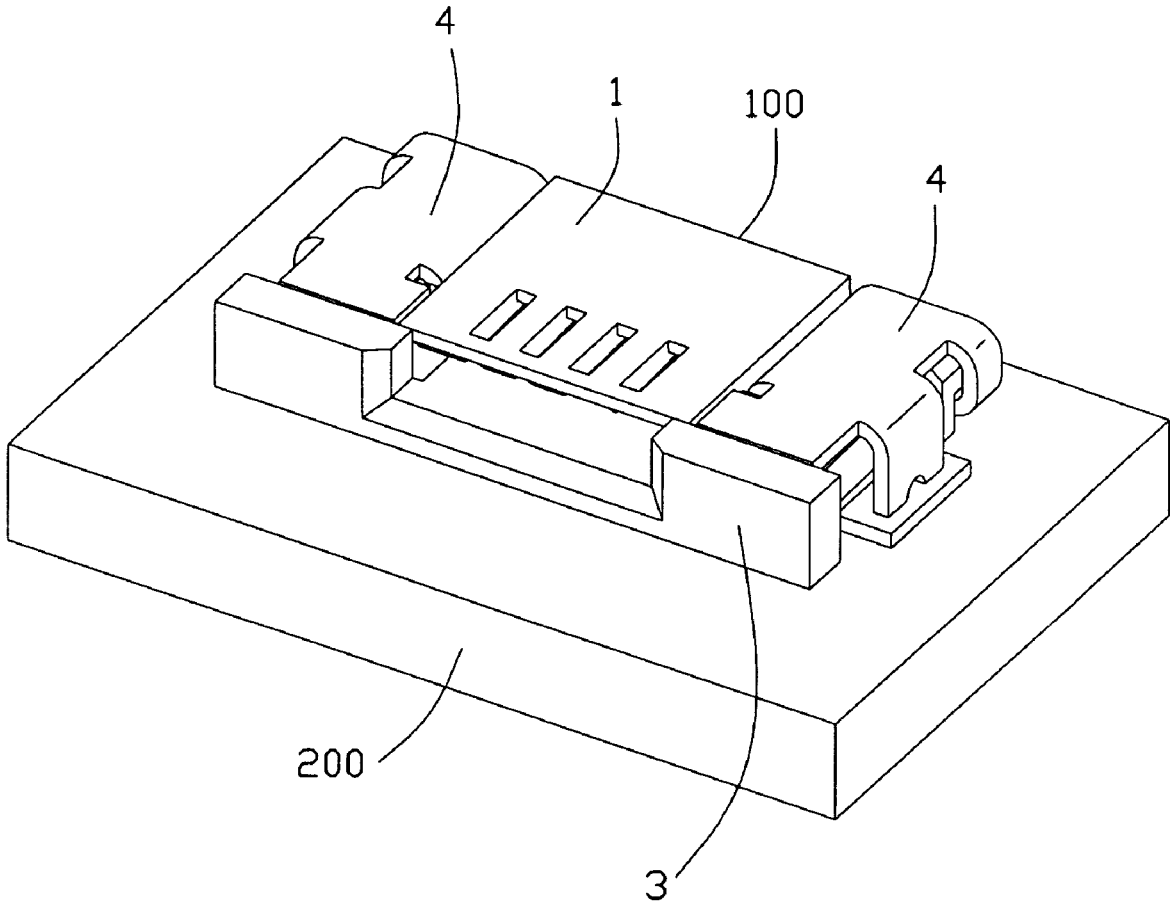
FIG. 1 is an assembled perspective view of an FPC connector mounted on a printed circuit board (PCB) in accordance with the preferred embodiment of the present invention.

Reference will now be made to the drawing figures to describe the preferred embodiment of the present invention in detail.

Referring to FIGS. 1–4, an FPC connector 100 for connecting an FPC to a printed circuit board (PCB) 200 in accordance with the present invention comprises an insulative housing 1, a plurality of terminals 2 loaded in the housing 1, an actuator 3 detachably assembled to the housing 1, and a pair of retaining ears 4.

Figure 7:
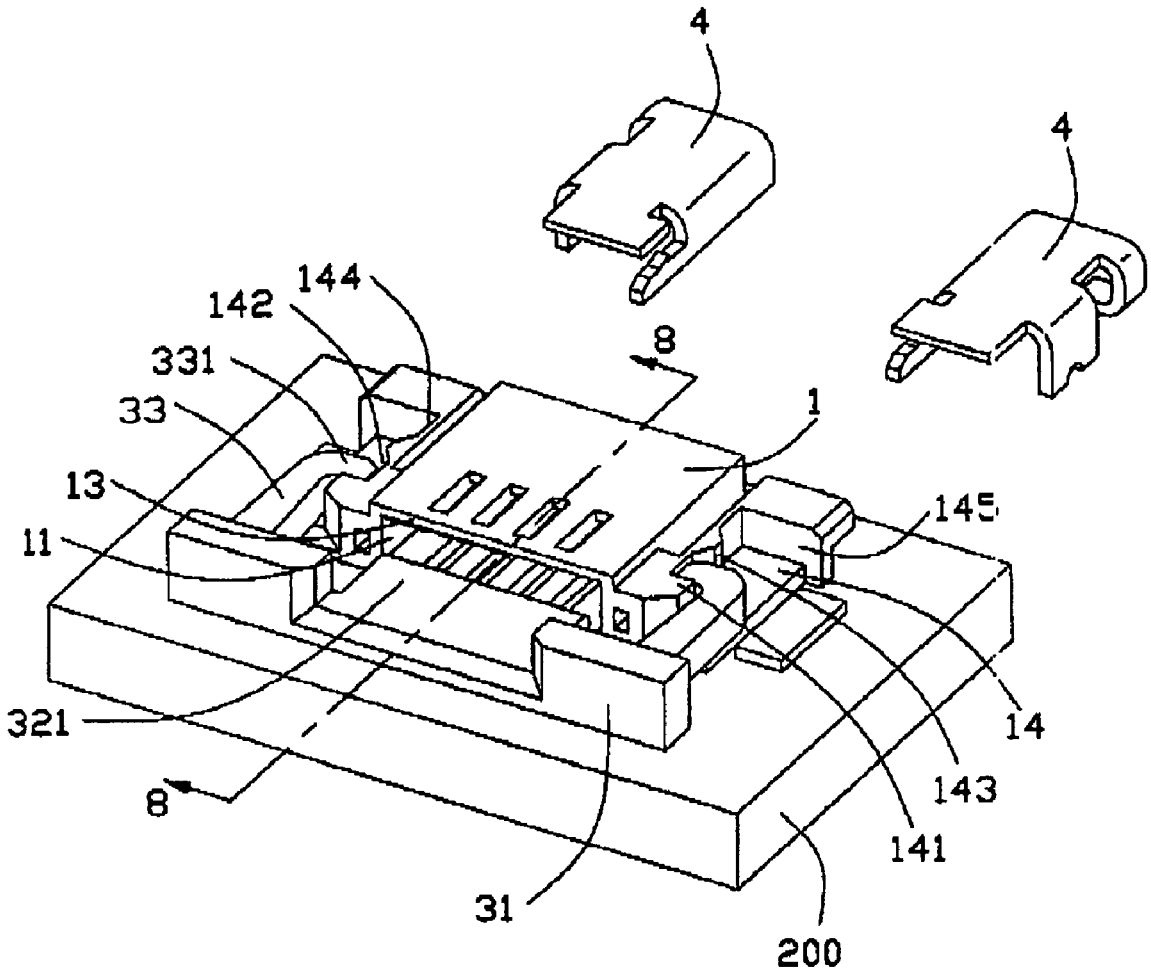
FIG. 7 is a partly assembled, perspective view of the FPC connector of FIG. 1 on the PCB, wherein the actuator is at the open position.
Figure 8:
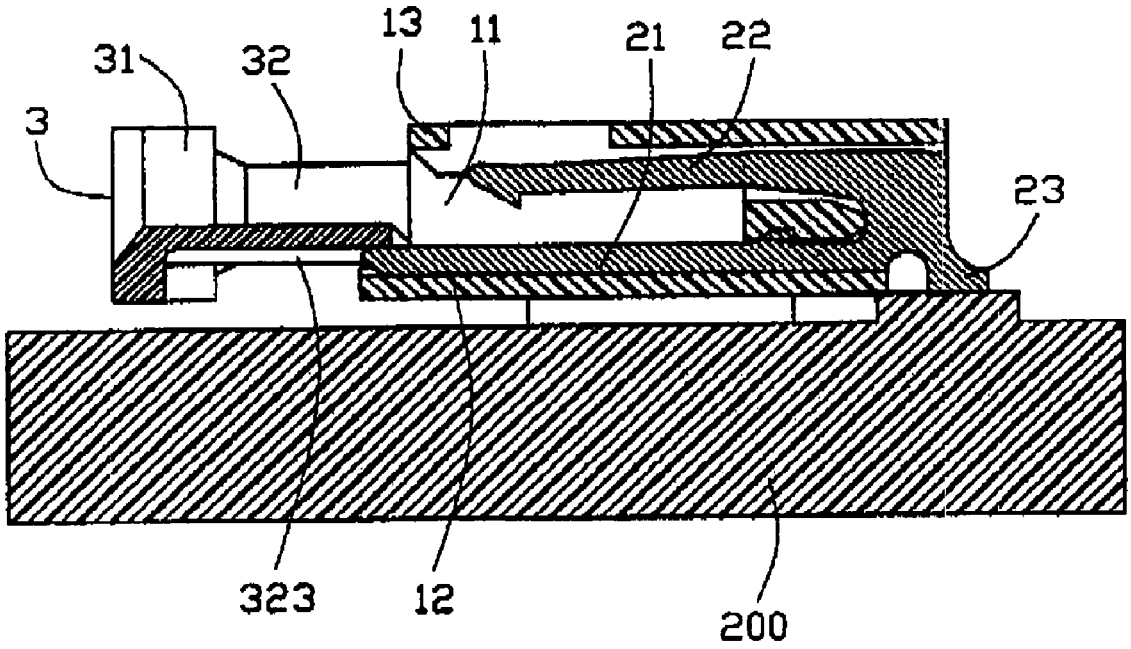
FIG. 8 is a cross-sectional view of the FPC connector of FIG. 7 taken along line 8—8.

The housing 1 comprises a middle portion formed with an upper wall 13 and a lower wall 12 defining a cavity 11 therebetween, and a pair of side portion 14 at two opposite sides of the middle portion. The cavity 11 is opened to a front face 10 of the housing 1 for receiving the actuator 3 and an FPC (not shown). A front-to-back direction perpendicular to the front face 10, along which the FPC is inserted into the cavity 11, is defined as an insertion direction B. In conjunction with reference to FIG. 7, the terminals 2 are inserted into the cavity 11 from a rear portion of the housing 1. Each terminal 2 comprises a fixed arm 21 extending oppositely along the insertion direction B and fixed in the lower wall 12, and an opposing resilient arm 22 extending parallel to the fixed arm 21 and received in the upper wall 13. Each resilient arm 22 has a barbed free end protruding into the cavity. Corresponding to the barbed free ends of the resilient arms 22, the upper wall 13 defines apertures therethrough to provide a space for deflection of the barbed free end. Each terminal 2 also has a tail 23 extending beyond the housing 1 for being soldered to the PCB 200.

Figure 2:
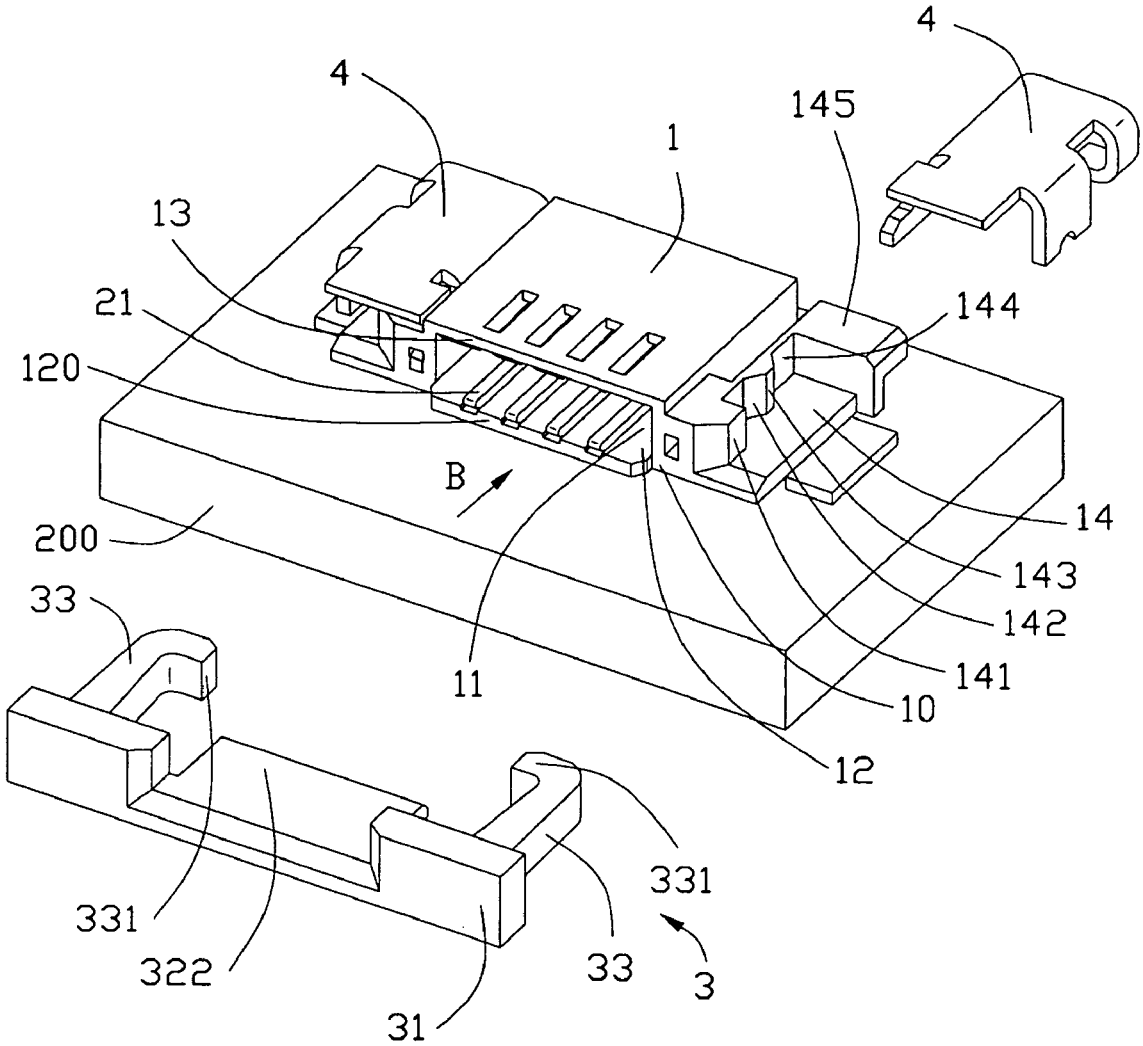
FIG. 2 is a partly exploded perspective view of the FPC connector of FIG. 1 on the PCB, wherein an actuator and one of retaining ears are detached from a housing of the connector.
Figure 4:
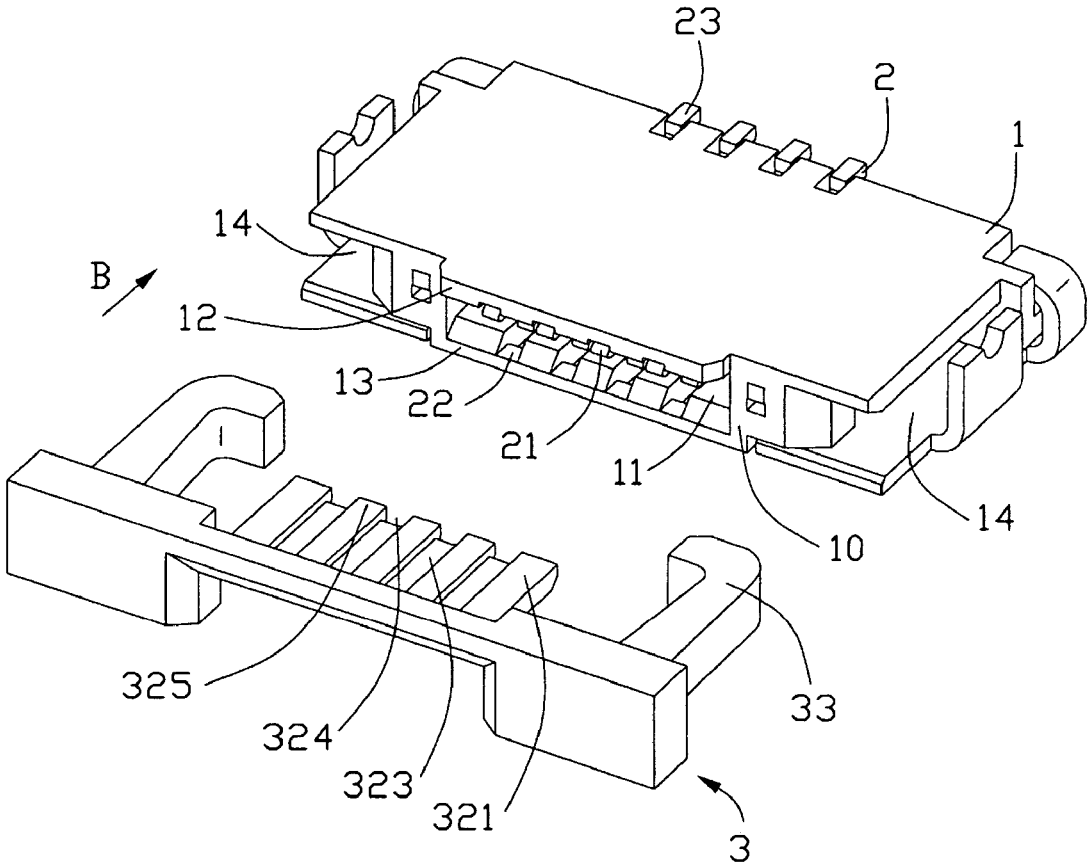
FIG. 4 is a view similar to FIG. 3 but taken from another aspect.

As best shown in FIGS. 2 and 4, the lower wall 12 has a front end 120 exposed to exterior, which is realized by the lower wall 12 extending forwards beyond the front face 10 in this preferred embodiment, and which also can be realized by the upper wall 13 backing off a little from the front face 10.

Each side portion 14 of the housing 1 is configured with a first tuber 141, a second tuber 143 and a stop block 145 which are spaced along the insertion direction B. The tubers 141, 143 define a first recess 142 therebetween, while the second tuber 143 and the stop block 145 define a second recess 144 therebetween. Both the two recesses 142, 144 are opened upwards and sidewards.

Figure 3:
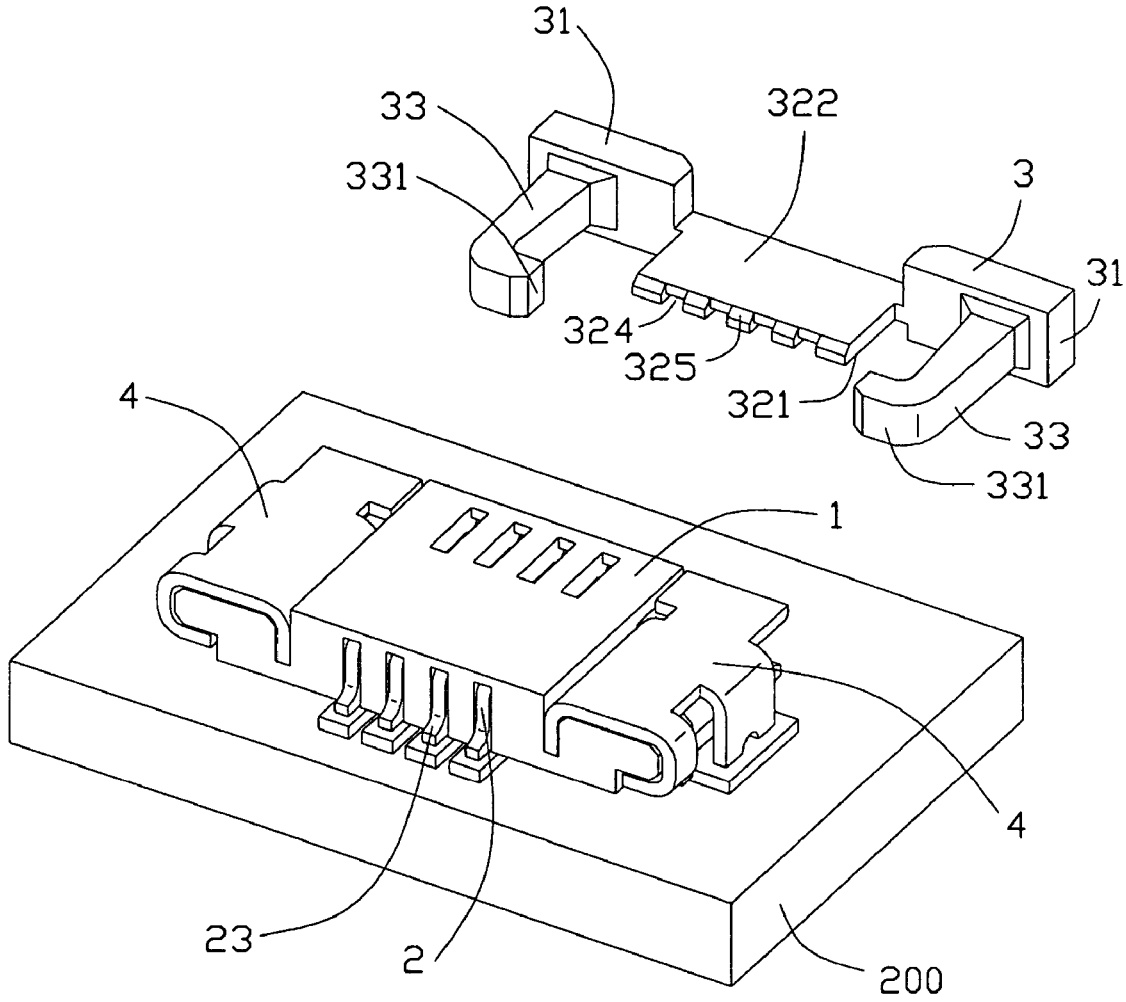
FIG. 3 is a second partly exploded perspective view of the FPC connector of FIG. 1 on the PCB, wherein only the actuator is detached from the housing.
Figure 5:
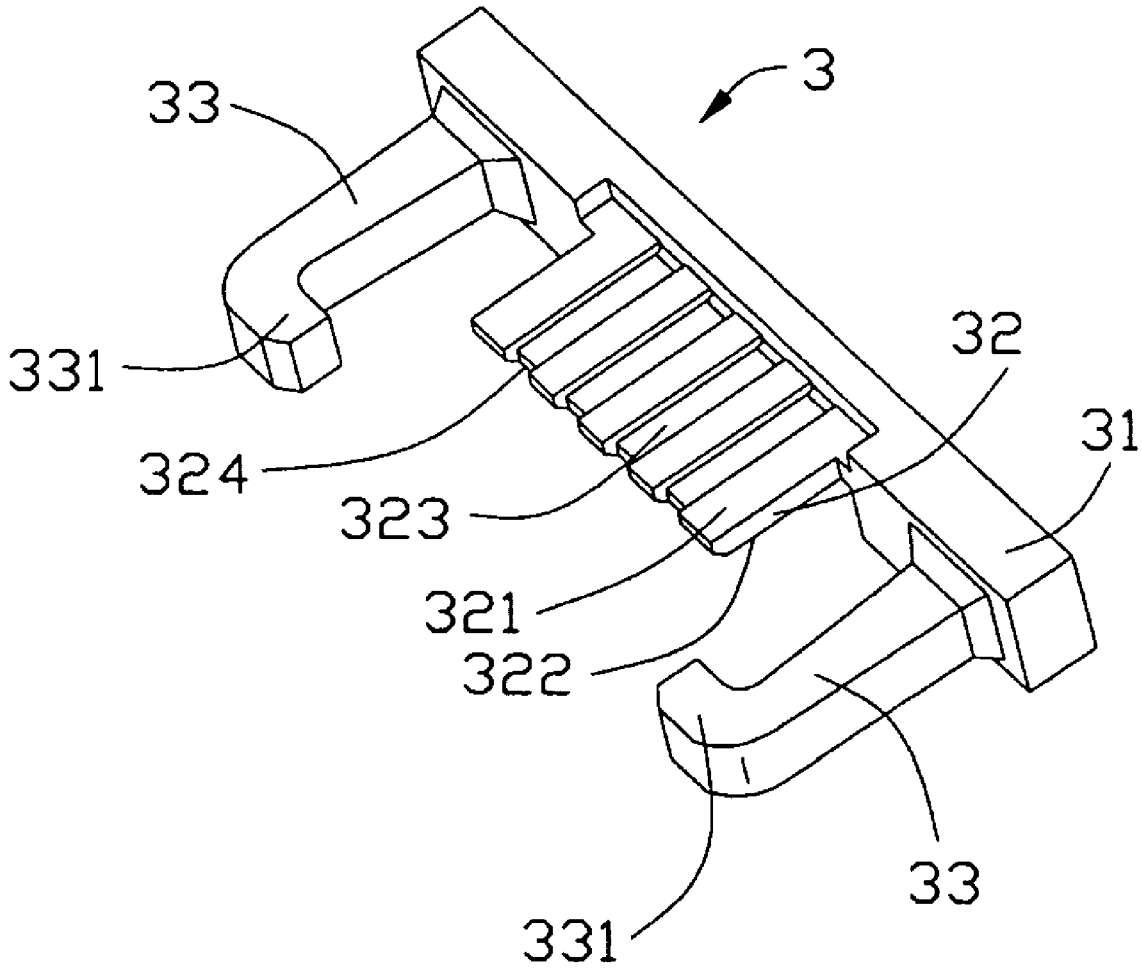
FIG. 5 is a perspective view of an actuator of the FPC connector of FIG. 1.

Referring to FIGS. 3 and 5, the actuator 3 comprises an elongated base 31, a tongue 32 extending from a middle section of the base 31, and a pair of side latches 33 extending from two opposite ends of the base 31. Each latch 33 has an inwardly protruding barb 331 at a free end thereof. The tongue 32 has an upper surface 322 inclined at a front end thereof and an under surface 321 defining a plurality of slots 323 corresponding to the fixed arms 21 of the terminals 2. The slot 323 extends upwards through the upper surface 322 to form a cutout 324 which gives birth to a pair of tips 325 therebeside accordingly. Thus the tongue 32 is provided with a comb-like shape at its front end, which is formed by an alternation of the cutouts 324 and the tips 325.

Figure 6:
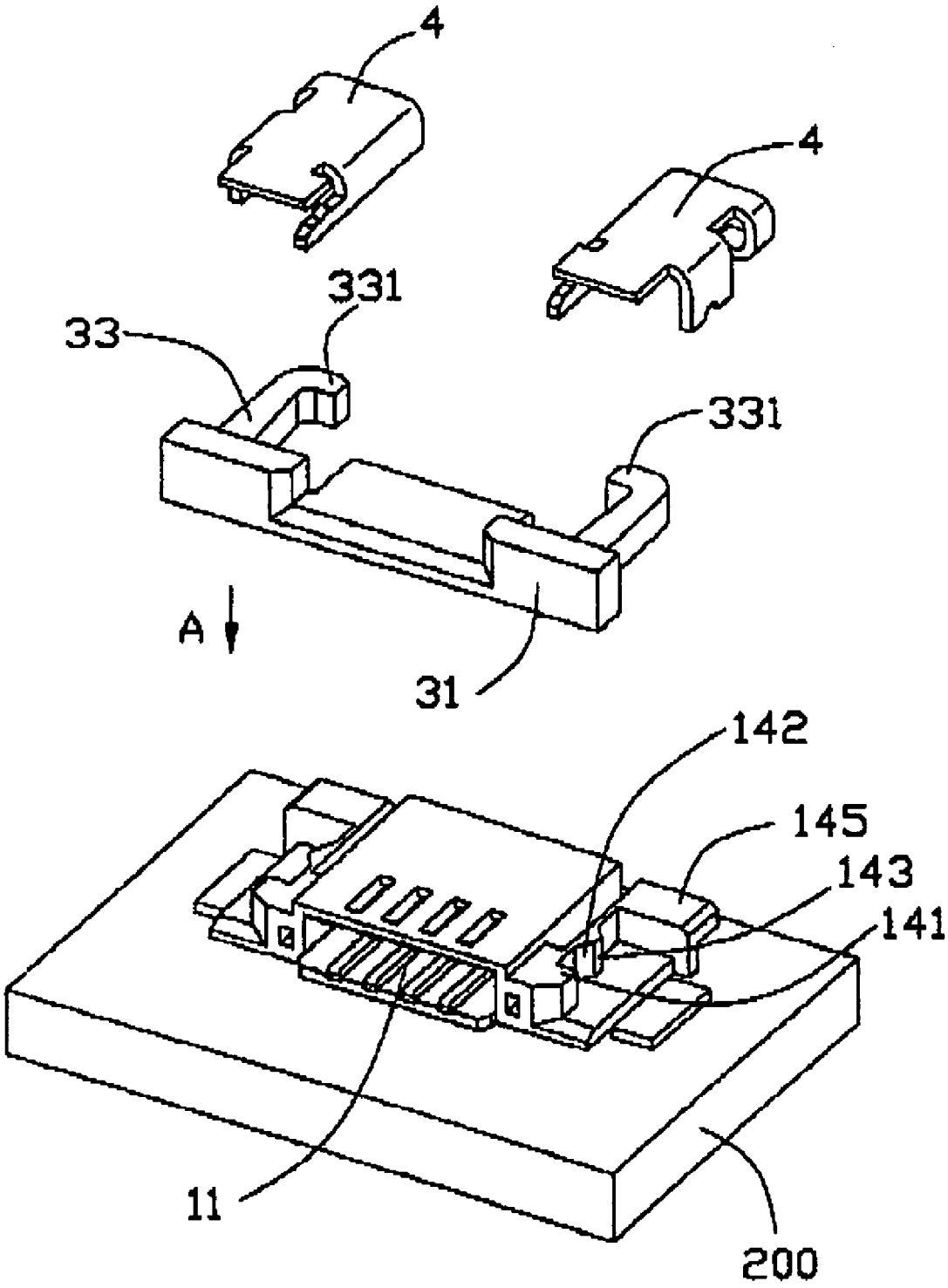
FIG. 6 is an exploded perspective view of the FPC connector of FIG. 1 on the PCB.

Referring to FIGS. 6–9 in conjunction with FIGS. 2 and 4, the actuator 3 is assembled to the housing 1 from an upside of the housing 1 with the barb 331 thereof vertically inserted into the first recess 142 without putting pressure on the housing 1 (the assembling direction designated as arrow A in FIG. 6). After the barb 311 received in the recess 142, the actuator 3 is in an open position relative to the housing 1 to receive the FPC, while the end section of the tongue 32 abuts on the front end 120 of the lower wall 12 of the housing 1 and front sections of the fixed arms 21 received in the slots 323 on under surface 321 of the tongue 32. Then the retaining ears 4 are assembled to the side portion 14 of the housing 1 for covering upward and sideward openings of the first recess 142 and the second recess 144 to prevent the latches 33 of the actuator 3 from upwardly or sidewards moving, each retaining ear has a grounding leg (not labeled) extending down to be soldered to the PCB 200.

As the front end of the tongue 32 is of a comb-like shape, when the actuator 3 is tilted by slightly raising the base 31 to form a slant insertion port for the sake of more convenient insertion of the FPC, the tips 325 of the tongue 32 remain abutting on the lower wall 12, while the fixed arms 21 of the terminals 2 being received in the cutout 324 of the tongue 32 as if the tips 325 are locked in gaps between fixed arms 21, therefore to prevent the actuator 3 from sidewards moving. Thus, even if the tongue 32 is a very tin one and the slots 323 are rather shallow, the actuator 3 will always align with the fixed arms 32 and the problem that a front edge of the tongue 32 sidewards slides on the fixed arms 21 can be avoided.

Figure 9:
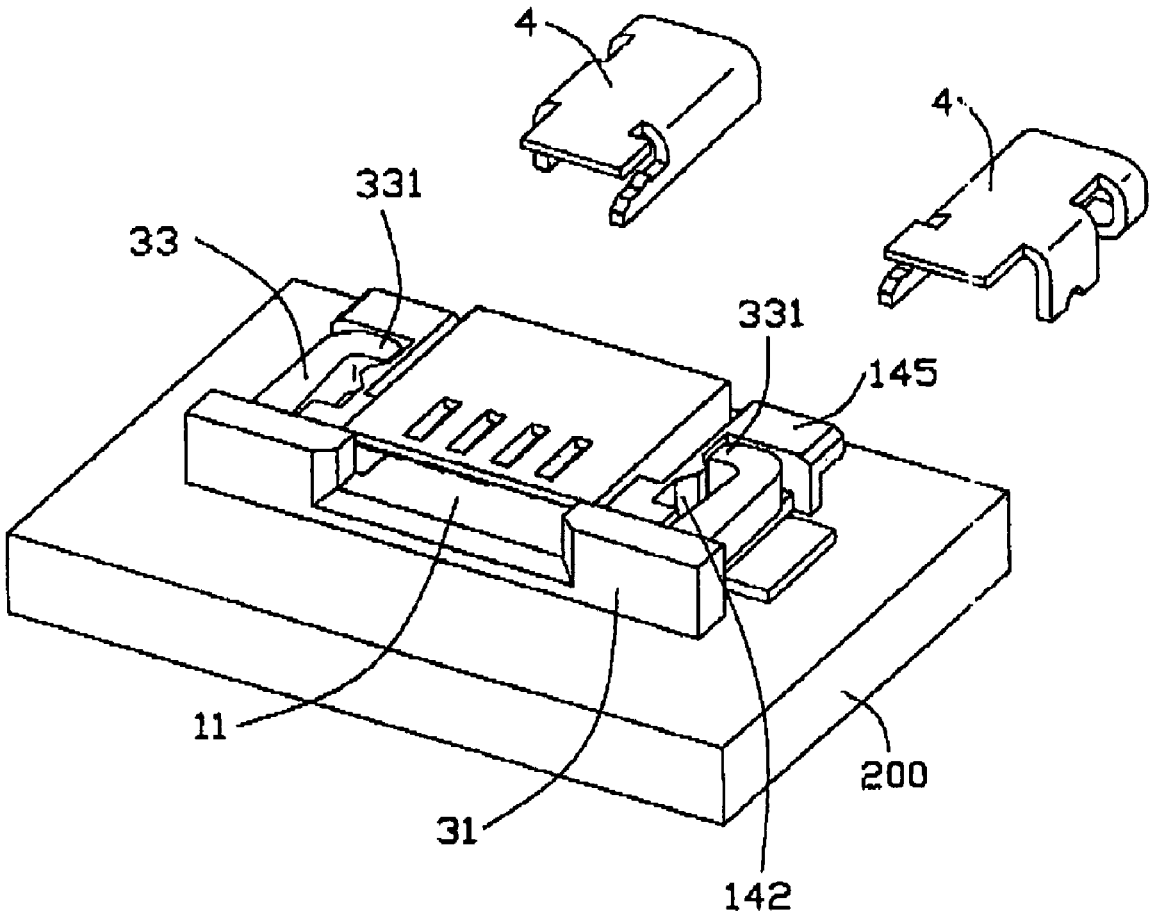
FIG. 9 is a view similar to FIG. 7, but the actuator is at the close position.

Then the FPC is inserted into the cavity 11 along the upper surface 322 of the tongue 32 from the above-mentioned slant insertion port. At last, the actuator 3 is pushed into the cavity 11 to urge the FPC thereon to electrically connect with the resilient arms 22 of the terminals 2. During this process, the fixed arms 21 of the terminals 2 fitly received in the slots 323 to guide the insertion of the tongue 31. Meanwhile, the latches 33 of the actuator 3 are forcedly slid from the first recess 142 into the second recess 144. Now the actuator 3 is in a closed position relative to the housing 1, as shown in FIG. 9.

Therefore, via a comb-like shaped end at the tongue 32, the actuator 3 of present invention perform a well alignment with the terminals 2 all through the process of insertion. However, the disclosure is illustrative only, changes may be made in detail, especially in matter of shape, size, and arrangement of parts within the principles of the invention.

The invention claimed is:

1. An electrical connector for a flexible printed circuit (FPC) comprising:

an insulative housing having a first wall and a second wall opposing to each other and defining a cavity therebetween opened to a front face of the housing;

a plurality of terminals loaded in the housing, each terminal provided with a fixed arm around the first wall and a resilient arm around the second wall and exposed to the cavity; and an actuator comprising a tongue insertable into the cavity, the tongue having a retaining surface adapted to retain the FPC in contact with the resilient arms, a guiding surface defining a plurality of slots to guidingly receive the fixed arms of the terminals for guiding the insertion of the tongue, and a plurality of cutouts at an end of the tongue, each cutout communicating with one of the slots correspondingly and running through the retaining surface and the guiding surface thereby to make the end of the tongue a comb-like shape;

wherein the actuator comprises a pair of side latches beside the tongue, each latch provided with an barbed end, and the housing defines two spaced recesses and a stop block at each side of the cavity for receiving the barbed end, and wherein the first recess is adjacent to the front face and the second recess is remote from the front face, and both recesses are opened upwards and sidewards;

wherein the connector further comprises a pair of retaining ears assembled to the housing to respectively cover the upward openings of the first and second recesses, and the stop blocks.

2. The electrical connector as described in claim 1, wherein the first wall extends forwardly beyond the front face of the housing to expose a front end thereof.

3. The electrical connector as described in claim 1, wherein the second wall backs off a little from the front face of the housing to expose a front end of the first wall.

4. The electrical connector as described in claim 1, wherein the tongue is in an open position relative to the housing for insertion of the FPC when the barbed ends are received in the first recesses, and when the barbed ends slide into the second recesses the tongue is in a closed position to urge the FPC to contact with the resilient arms.

5. The electrical connector as described in claim 1, wherein the actuator is assembled to the housing from an upside portion of the housing with the bated ends of the latches vertically inserted into the first recess.

6. An electrical connector for use with a flexible printed circuit (FPC), comprising:

an insulative housing defining opposite first and second walls with a cavity therebetween;

a plurality of terminals disposed in the housing with respective contacting arms extending into the cavity around the first wall for electrical and mechanical engagement with the FPC;

a plurality of fixed arms applied around the second wall and exposed to the cavity; and an actuator attached to the housing and moveable between outer and inner positions in a horizontal direction, said actuator defining a tongue insertable into the cavity, a retaining surface facing toward the first wall for cooperating with the first wall to sandwich the FPC therebetween, and a guiding surface, opposite to the retaining surface and facing to the second wall, defining a plurality of slots in alignment with the corresponding fixed arms in said horizontal direction, respectively, so as to receive said corresponding fixed arms therein when said actuator is moved from the outer position to the inner position; wherein the fixed arms protrude forwardly beyond the contacting arms in said horizontal direction;

wherein the actuator comprises a pair of side latches beside the tongue, each latch provided with an barbed end, and the housing defines two spaced recesses and a stop block at each side of the cavity for receiving the barbed end, and wherein the first recess is adjacent to the front face and the second recess is remote from the front face, and both recesses are opened upwards and sidewards;

wherein the connector further comprises a pair of retaining ears assembled to the housing to respectively cover the upward openings of the first and second recesses, and the stop blocks.

7. The electrical connector as claimed in claim 6, wherein a front region of the fixed arm is received in the corresponding slot when said actuator is located in the outer position, and a front half section of said fixed arm is received in the corresponding slot when said actuator is located in the inner position.

8. The electrical connector as claimed in claim 6, wherein the fixed arms protrude beyond a front face of the first wall of the housing.

9. The electrical connector as claimed in claim 8, wherein a front face of the second wall of the housing is located in front of the front face of the first wall.

10. The electrical connector as claimed in claim 6, wherein the fixed arms are aligned with the corresponding contacts in said horizontal direction, respectively.

11. The electrical connector as claimed in claim 10, wherein the fixed arms are integrally formed with the corresponding contacts, respectively.

12. The electrical connector as claimed in claim 6, wherein the first wall is located above the second wall.

13. The electrical connector as claimed in claim 12, wherein said actuator is assembled to the housing in a vertical direction defined from the first wall to the second wall.

14. An electrical connector assembly for use with a flexible printed circuit (FPC), comprising;

a printed circuit board;

an insulative housing seated upon the printed circuit board and defining opposite upper and lower walls with a cavity therebetween;

a plurality of terminals disposed in the housing with respective contacting arms extending into the cavity around the first wall for electrical and mechanical engagement with the FPC;

a plurality of fixed arms applied around the lower wall and exposed to the cavity; and an actuator attached to the housing and moveable between outer and inner positions in a horizontal direction, said actuator defining a tongue insertable into the cavity, a retaining surface facing toward the upper wall for cooperating with the upper wall to sandwich the FPC therebetween, and a guiding surface, opposite to the upper wall and facing to the lower wall, defining a plurality of slots in alignment with the corresponding fixed arms in said horizontal direction, respectively, so as to receive said corresponding fixed arms therein when said actuator is moved from the outer position to the inner position, and a plurality of cutouts at an end of the tongue, each cutout communicating with one of the slots correspondingly and running through the retaining surface and the guiding surface thereby to make the end of the tongue a com-like shape; wherein the lower wall protrudes forwardly beyond the upper wall in said horizontal direction;

wherein said fixed arms forwardly protrude beyond the contacting arms with front end regions received in the corresponding slots, respectively, when said actuator is located in the outer position;

wherein when the actuator is located in the outer position, the front edge region of the actuator is seated upon a front region of the lower wall while the front edge of said actuator is located in front of a front face of the upper wall.

15. The connector assembly as claimed in claim 14, wherein the fixed arms protrude beyond a front face of the upper wall of the housing.

16. The connector assembly as claimed in claim 14, wherein each of said terminals and the corresponding one of the fixed arms, which are aligned in a same plane, are integrally formed with each other.

* * * * *